US008745955B2

(12) United States Patent
Goulet

(10) Patent No.: US 8,745,955 B2
(45) Date of Patent: Jun. 10, 2014

(54) METHODS FOR FORMING A JUMP PIT

(75) Inventor: Burt Goulet, Bloomville, NY (US)

(73) Assignee: Sportsfield Intellectual, LLC, Delhi, NY (US)

( * ) Notice: Subject to any disclaimer, the term of this patent is extended or adjusted under 35 U.S.C. 154(b) by 0 days.

(21) Appl. No.: 13/482,543

(22) Filed: May 29, 2012

(65) Prior Publication Data

US 2012/0285117 A1 Nov. 15, 2012

Related U.S. Application Data

(63) Continuation of application No. 12/621,806, filed on Nov. 19, 2009, now Pat. No. 8,186,125, which is a continuation of application No. 11/406,200, filed on Apr. 18, 2006, now Pat. No. 7,641,593.

(60) Provisional application No. 60/674,236, filed on Apr. 22, 2005.

(51) Int. Cl.
*A63B 5/00* (2006.01)

(52) U.S. Cl.
CPC ..... *A63B 5/00* (2013.01)
USPC ..... 52/741.1

(58) Field of Classification Search
USPC ..... 52/302.3, 169.1, 169.7, 169.8, 741.1, 52/745.02, 745.13, 747.1; 482/14, 15; 404/2
See application file for complete search history.

(56) References Cited

U.S. PATENT DOCUMENTS

| | | | | |
|---|---|---|---|---|
| 2,588,722 | A | 3/1952 | Hendershott | |
| 3,369,808 | A | 2/1968 | Sconce | |
| 3,682,476 | A | 8/1972 | Kempson et al. | |
| 4,223,501 | A | 9/1980 | DeLozier | |
| 4,882,882 | A | 11/1989 | Werner | |
| 5,454,195 | A * | 10/1995 | Hallsten | 52/169.1 |
| 5,647,692 | A | 7/1997 | Gunter | |
| 6,240,700 | B1 * | 6/2001 | Sheu | 52/169.1 |
| 7,641,593 | B2 | 1/2010 | Goulet | |
| 8,186,125 | B2 | 5/2012 | Goulet | |

OTHER PUBLICATIONS

"Sand Pit Forms and Cover Systems," Gill Athletics, http://www.gillathletics.com/favilityCD/facilityCD_files/Page574.htm, 1-page, Apr. 24, 2007.

F440-29'-7" LJ TJ Sandpit Form with Sand Catcher Specifications; Gill Athletics, Champaign, IL, 9-pages, Oct. 22, 2004.

F420-29' LJ TJ Sandpit Form with Ledge Specification, Gill Athletics, Champaign, IL, 6-pages, Oct. 22, 2004.

(Continued)

*Primary Examiner* — Joshua J Michener
*Assistant Examiner* — Matthew J Smith
(74) *Attorney, Agent, or Firm* — Heslin Rothenberg Farley & Mesiti P.C.

(57) ABSTRACT

A form is provided for constructing a jump pit with a sand area. The form is constructed in sections. Each section has an inside wall and an outside wall. A support member is located between the outside wall and the inside wall. The sections are secured together onsite. Caps are mounted on the support members. The caps include an inclined surface which slops upwardly and away from the sand area forming the inclined surface. A cover over the sand area is supported by the inclined surface. Optionally, a chamber is located adjacent the outside wall. A grate covers the chamber and the grate is supported by a brace. A mat covers the grate. Openings in the grate and in the mat permit sand through them, thrown from the sand area to drop into the chamber.

17 Claims, 8 Drawing Sheets

(56) References Cited

OTHER PUBLICATIONS

F400-29' LJ TJ Sandpit Form Specifications, Gill Athletics, Champaign, IL, 6-pages, Oct. 22, 2004.
Cages and Inground Equipment, Section 2, Long Jump/Triple Jump Pit, Sand Catcher and Cover System, UCS Track & Field, Sports and Recreational Products, http://www.ec-securehost.com/UCSInc/Cages_and_Inground_Equipment_-_Section_2.html, 5-pages, Dec. 12, 2003.
Jump Pit Systems Brochure, Sports Edge, 8 pages, 2000.
NCAA and High School Long/Triple Jump Sand Pit with Sand Catchers and Cover Ledge, Sports Edge, Model Nos. SP6000, SP6010, SP6020, SP6012, SP6022, SP6014, SP6024, Cut Sheets and Installation Instructions, 17-pages, 2002.
Steeple Chase Water Jump Pit, Sports Edge, Model No. WJ5000, Cut Sheets and Installation Notes, 7-pages, 2002.

* cited by examiner

METHODS FOR FORMING A JUMP PIT

RELATED APPLICATIONS

This application is a continuation of U.S. patent application Ser. No. 12/621,806, filed Nov. 19, 2009, now U.S. Pat. No. 8,186,125, entitled "Jump Pit Form" which is a continuation of U.S. patent application Ser. No. 11/406,200, filed Apr. 18, 2006, now U.S. Pat. No. 7,641,593, entitled "Jump Pit Form", which claims priority based upon U.S. Provisional Patent Application Ser. No. 60/674,236 filed on Apr. 22, 2005, the entire subject matter of these applications are incorporated herein by reference.

BACKGROUND OF THE INVENTION

1. Field of The Invention

This invention relates to forms and, most specifically, relates to forms for constructing jump pits used as a landing area for athletes.

2. Prior Art

Jump pits, which are well known in field sports, are used as a reasonably safe landing place in athletic activities for broad jumps and high jumps. Jump pits have specific standards and compliance with these standards is vital and critical.

In the past, forms were hand constructed onsite. Such hand constructed forms were frequently not accurate and thus failed to provide certainty of size. Obviously, hand construction is time consuming and thus expensive.

When an athlete lands in a jump pit which is filled with sand, sand from the sand pit is frequently thrown up in the air and outside of the jump pit itself. This results in loss of sand and creates a clean up situation. Therefore, it is most desirable that a sand pit or jump pit has an area surrounding the jump pit for rapidly reclaiming sand thrown from the jump pit. Athletic fields are used for a variety of events. Therefore, a jump pit and any associated sand recover area needs to be capable of being covered.

OBJECTS

The objects of this invention are as follows:

1. To provide a jump pit form that is manufactured off site and is then readily assembled on site for construction of the jump pit.
2. To provide a jump pit form which remains part of the jump pit and is attractive.
3. To provide a form for constructing a jump pit that produces an accurate jump pit.
4. To provide a form for a jump pit that includes a sand catcher.
5. To provide the jump pit that is durable and economical.

These and other objects of the present invention will become readily apparent upon further review of the following specifications and drawings.

SUMMARY OF THE INVENTION

A jump pit form is provided for constructing a jump pit with a sand area which includes a base form having an inside wall and an outside wall. Support members are located between the outside wall and the inside wall. A cap is mounted on the support members, the cap having an inclined surface. A cover is supported by the inclined surface and covers the sand area.

BRIEF DESCRIPTION OF THE NUMERALS

21 Base Form
23 Sections
25 Straight Sections
27 Corner Sections
29 Top
31 Inside Wall
33 Sand Area
35 Outside Wall
36 Interior Surfaces
37 Support Members
39 Short Part
41 Long Part
43 Short Side
45 Long Side
47 Vertical Channels
49 Cross Member
51 Three Large Circular Openings
53 Outside Panel
54 Top Panel
55 Interior Surface
57 Inside Panel
59 Interior Surface
61 Small Openings
63 Base Panel
65 Bottom
67 Wall Part
69 Top Part
71 Bottom Part
73 Vertical lips
75 Sand Catcher
77 Cap
79 Cap Base
81 Inside Cap Wall
83 Support Surface
85 Cover
87 Outside Cap Wall
88 Flat Members
89 Synthetic Track Surface
91 Catcher Sections
93 Wall Cap

95 Chamber
97 Horizontal Bottom
99 Two Vertical Enclosures
103 Crushed Stone
105 Outside Vertical Enclosure
107 Inside Vertical Enclosure
109 Partial Cap
111 Inclined Surface
113 Brace
114 Grate
116 Mat
118 Opening
121 Bolt
123 Bar
125 Retainer
127 Crushed Stone
129 Geotextile

DETAILED DESCRIPTION OF THE PREFERRED EMBODIMENT

Figure 1:
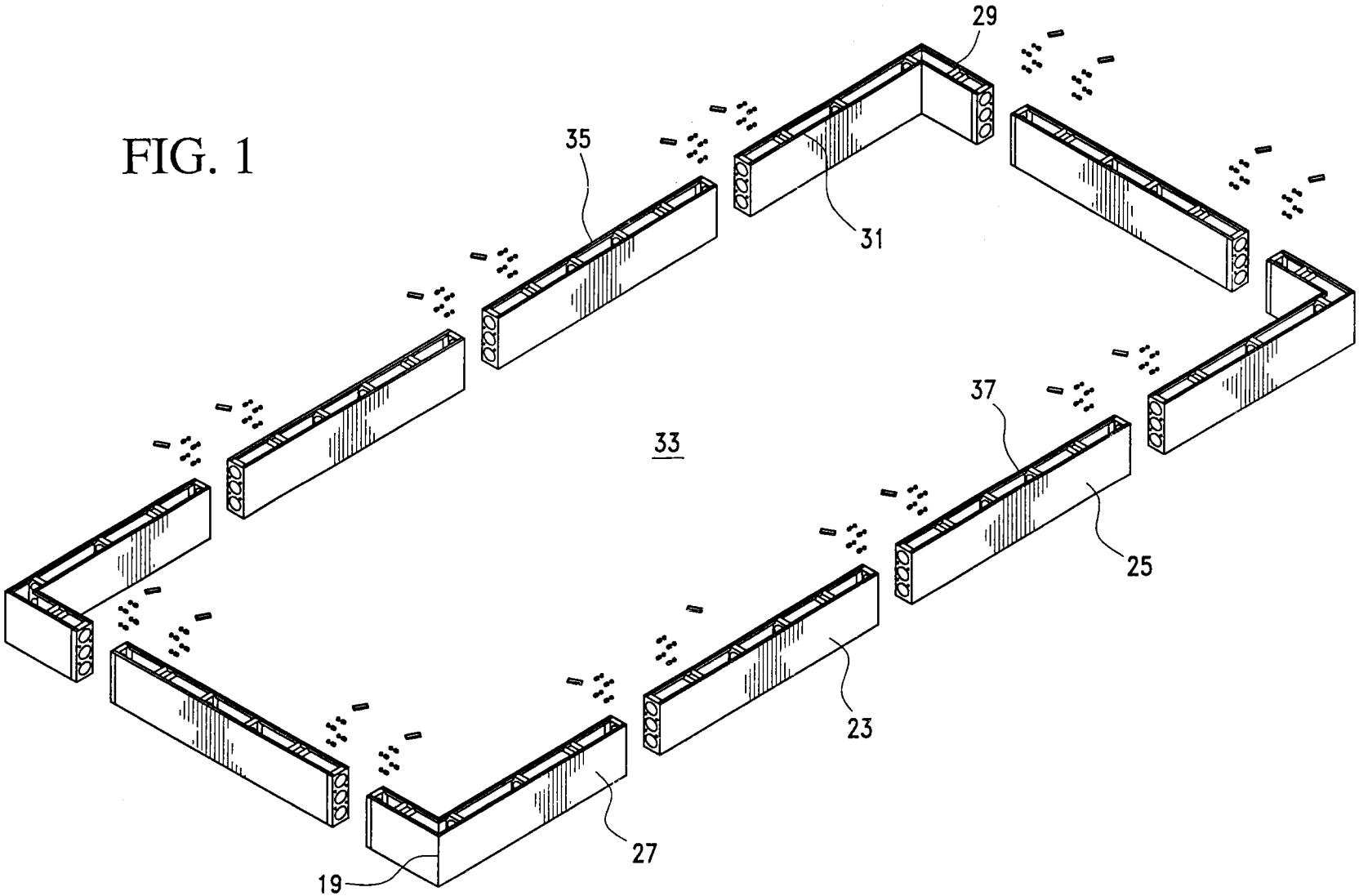
FIG. 1 is an exploded pictorial view of the base form for constructing a jump pit showing the individual sections used to construct the base form.

Referring now to FIG. 1, the base form 21 is shown. The base form 21 is prefabricated in sections 23, namely straight sections 25 and corner sections 27. The sections 23 are connected together and filled with cement. The top 29 of the base form 21 is located beneath the surface of an athletic field.

Both the corner sections 27 and the straight sections 25 have an inside wall 31, which is located toward the inside of the sand area 33 and an outside wall 35 facing away from the sand area 33. Both the outside wall 35 and the inside wall 31 have interior surfaces 36 between the outside wall 35, and the inside wall 31 where support members 37 are located. Support members 37 are secured to the outside wall 35 and to the inside wall 31, preferably by welding, but other means such as the use of bolts is also possible. The support members 37 are spaced from one another to assure that the inside wall 31, and the outside wall 35 neither bulges nor separates from one another in the placement of the cement between the outside wall 35 and the inside wall 31.

Figure 2:
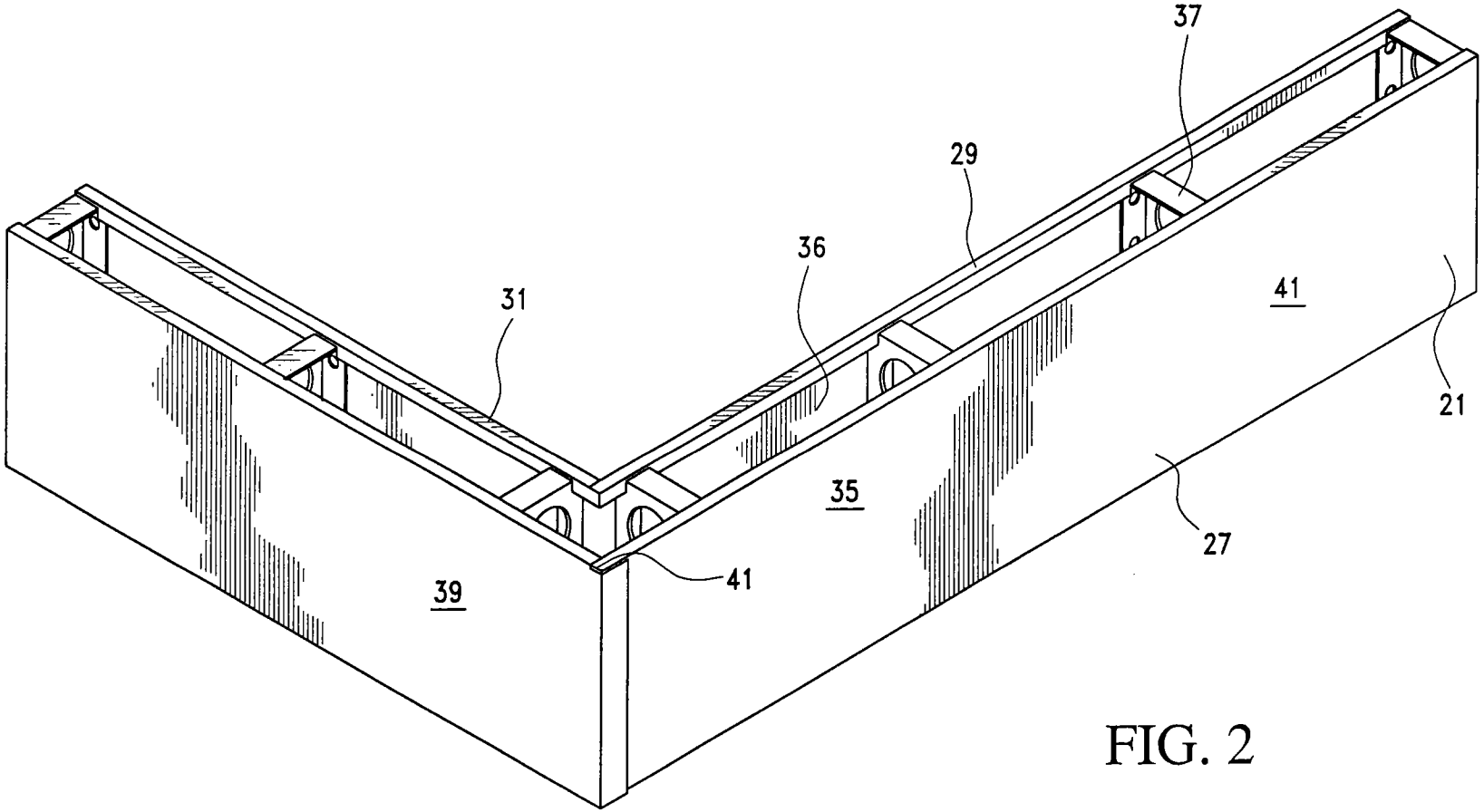
FIG. 2 is a perspective view of a corner of the form for the jump pit showing support members between the inside wall, and the outside wall of the form.

Referring now to FIG. 2, one corner, section 27 is shown. Each corner section 27 has a short part 39 and a long part 41. As seen in FIG. 1, the short part 39 is placed along the shorter side 43 of the base form 21, which has a rectangular cross section. The long part 41, therefore, is located along a long side 45 of the base form 21.

The shorter part 39 of each corner section of 27 is formed with vertical channels 41 in the corner section 27, both on the inside wall 31 and the outside wall 35 of the shorter part 39. The inside wall 31, and the outside wall 35 of the long part 41 slip fits into the respective vertical channel 47 in the short part 39, and is secured, preferably by welding.

Figure 4:
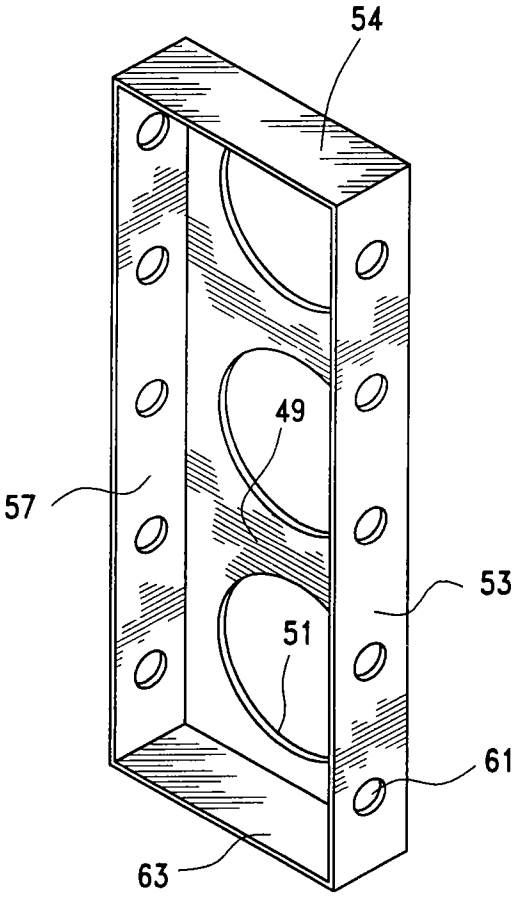
FIG. 4 is a pictorial view of a support member.
Figure 3B:
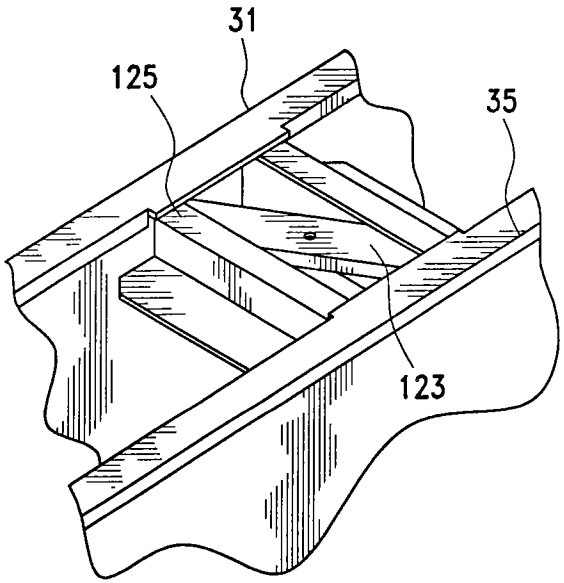
FIG. 3B is a pictorial view of a portion of the top of the base form showing a bar and a retainer with a threaded opening for bolting a cap and a sand catcher to the base form.
Figure 3A:
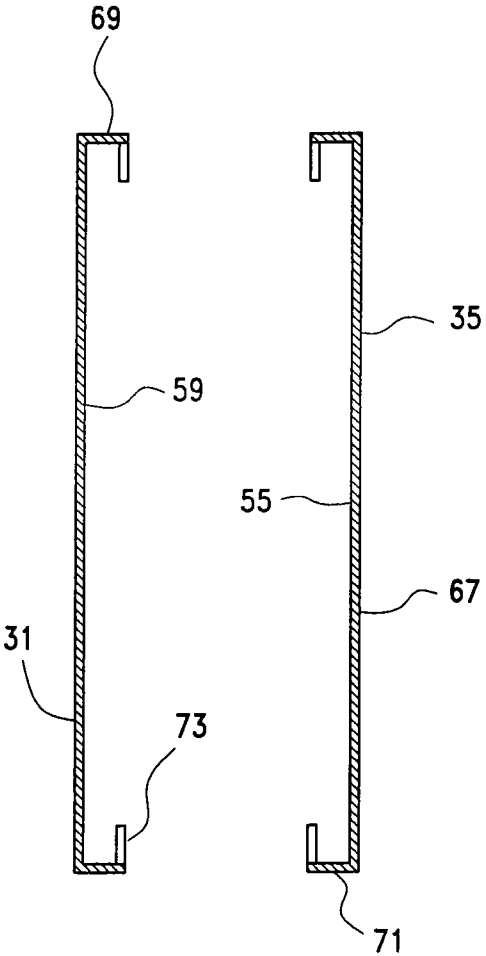
FIG. 3A is a cross-sectional view of the outside all and the inside wall of the base form without a support member.

The support members 37 (FIG. 4) are formed from sheet metal, preferably aluminum, which is also preferably utilized for the inside wall 31 and the outside wall 35. Each support member 37 has a cross member 49 that extends from the outside wall 35 to the inside wall 31. The cross number 49 includes three large circular openings 51, which permit the poured cement to flow between the support members 37. Each support member 37 also has an outside panel 53, located substantially at a right angle to the cross member 49 and which is secured to the interior surface 55 of the outside wall 35. Each support member 37 also has a top panel 54 and an inside panel 57 which is located substantially at a right angle to the cross member 49, and which is secured to the interior surface 59 of the inside wall 31. Small openings 61 are located in the outside panel 53, and the inside panel 57. There is also a base panel 63 extending at the bottom of the base form 21 substantially at right angles from the cross member 49 and from the outside panel 53 and the inside panel 57. The top panel 54 extends from the top of the base form 21 substantially at right angles from the cross member 49 and from the outside panel 53 and the inside panel 57.

Both the inside wall 31 and the outside wall 35 have a wall part 67 and a top part 69 and bottom part 71. The top part 69 and the bottom part 71, are substantially at right angles to the inside wall 31 and the outside wall 35. Vertical lips 73 extend at a short distance from the top panel 69, and the bottom panel 71. The vertical lips 73 are notched to permit the support members 37 to be secured to the interior surfaces 55, 59, of the inside wall 31 and the outside wall 35.

Figure 3:
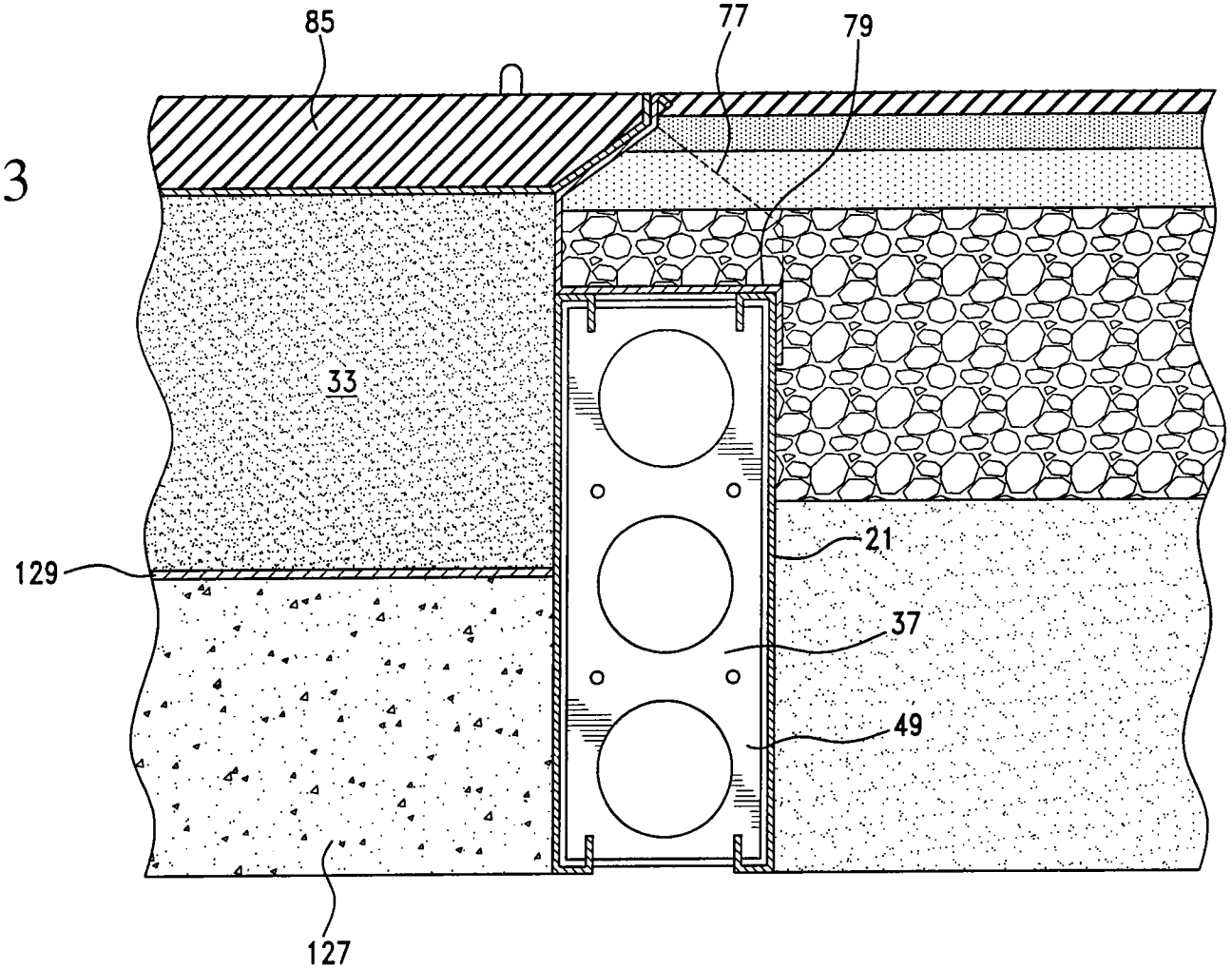
FIG. 3 is a cross-sectional view of the base form at a support member of the jump pit showing the support member with a cap on the wall but without any sand catcher.
Figure 5:
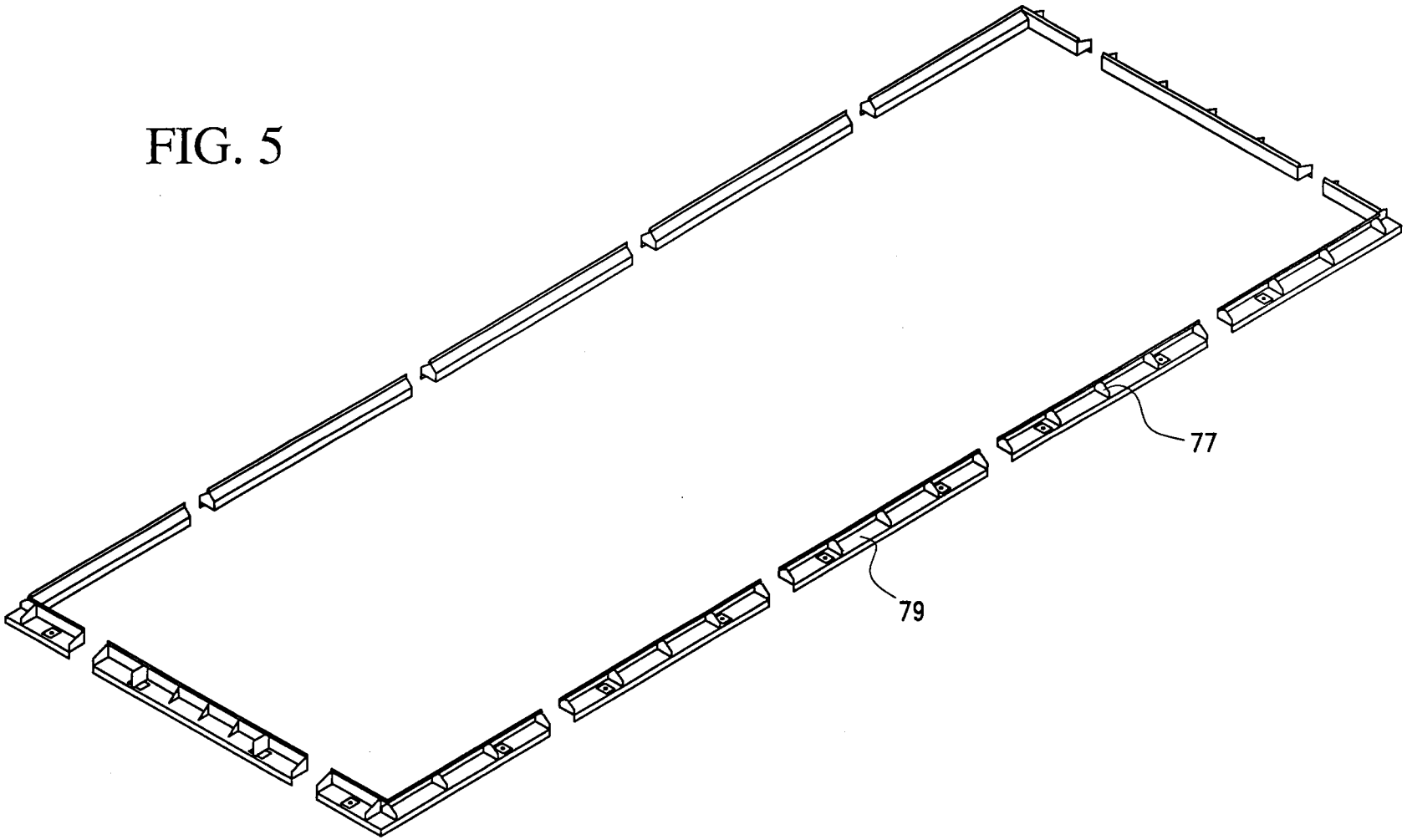
FIG. 5 is a pictorial view of the cover for the base form when no sand catcher is utilized.

When the base form 21 is used without a sand catcher 75, a cap 77 is placed over the top of each support member 37, as can be seen in FIG. 3 and in FIG. 5. The cap 77, as best seen in FIG. 5, has a cap base 79, which is secured to the base form 21. The inside cap wall 31, which faces the sand area 33, extends generally vertically upwardly and then slopes upwardly at an acute angle away from the sand area 33. This sloping of the cap 77 provides a support surface 83 for a cover 85 over the sand area 33.

An outside cap wall 87 (FIG. 3) slopes downwardly from the inside cap wall 81 and then extends vertically downwardly to the top of the outside wall 35. As best seen in FIG. 5, the outside cap wall 87 is a flat member 88 placed on the cap base 79. The outside cap wall 87 provides strength to the cap 77. A synthetic track surface 89 (FIG. 3) may abut the cover 85 above the support surface 83.

Figure 6:
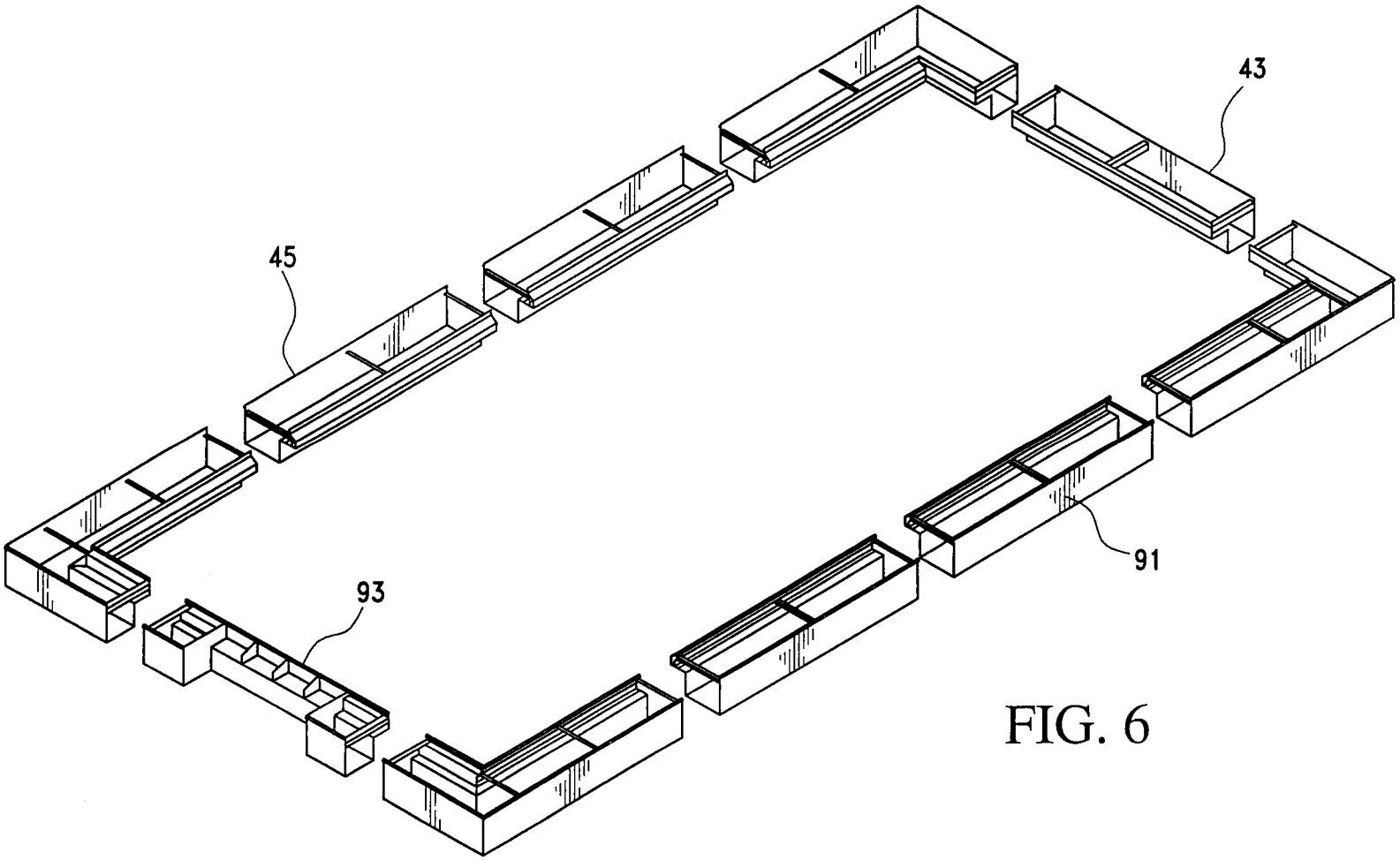
FIG. 6 is a sectional pictorial view of the sand catcher.
Figure 7:
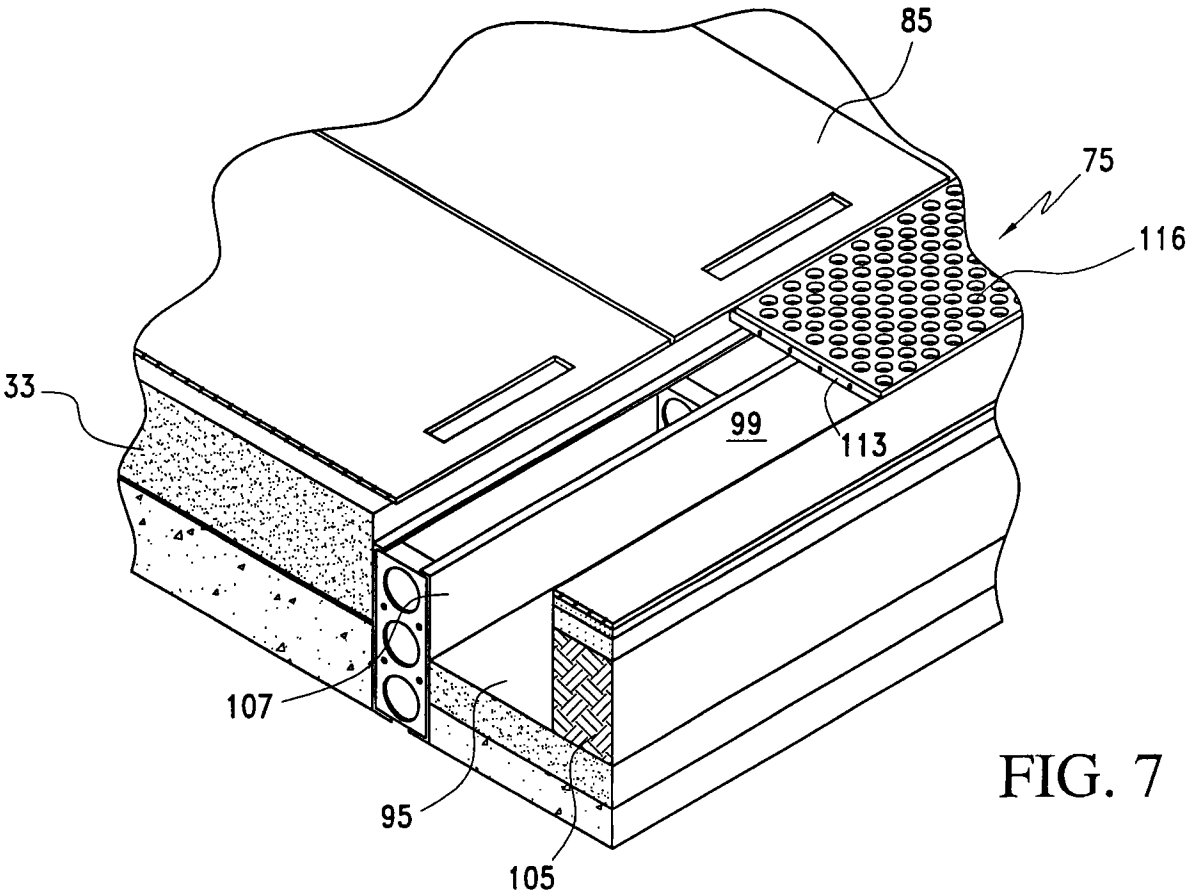
FIG. 7 is a pictorial view showing the base form with a sand catcher.
Figure 8:
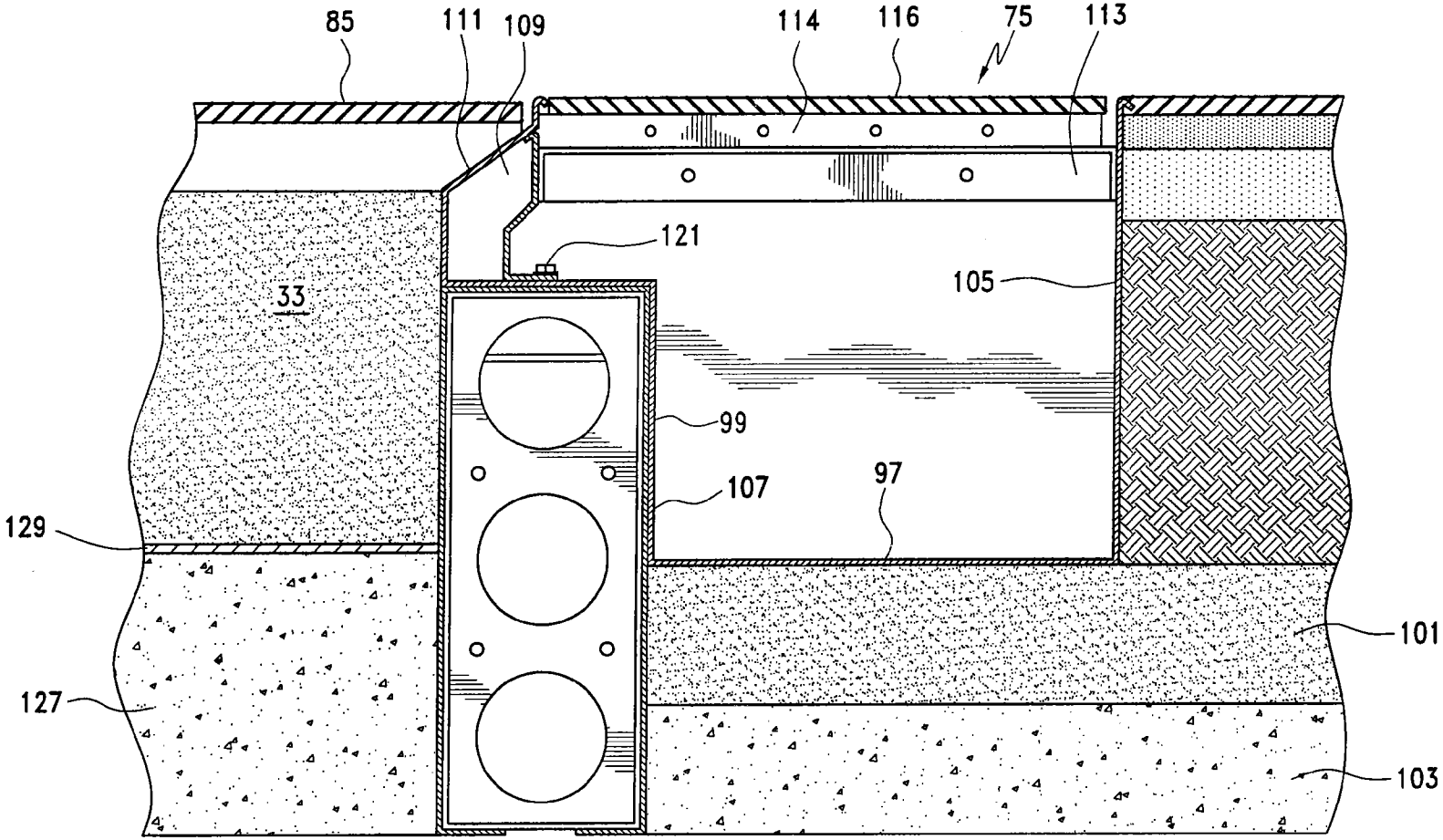
FIG. 8 is a cross-sectional view of the base form with a sand catcher.

As has been previously stated, a jump pit is best provided with a sand catcher 75. The construction of the base form 21 remains the same as previously described. As best seen in FIG. 6, the sand catcher 75 is also made in catcher sections 91, which are secured together, at the site of installation. The sand catcher 75, surrounds most of the sand area 33, but not necessarily all of the sand area 33. Since a jump pit is situated so that a jumper will approach the jump pit from one direction, the jumper lands in the jump pit so as to throw sand from the jump pit over certain sections. For this reason, a jump pit has the sand catcher 75 along three of the four sides, 43, 45, as seen in FIG. 6.

Referring now to FIG. 6, one short side 43 does not include a sand catcher 75. All of the other three sides 43, 45 does include a sand catcher 75. The one short side 43, not having a sand catcher 75, includes a wall cap 93, used where no sand catcher 75 exists, as previously described. When the sand catcher 75 is used, the cap 77, is previously described, is not used. The sand catcher 75 includes a chamber 95 with a partial cap 109 on the support members 37. The chamber 95 has a rectangular cross-section with a horizontal bottom 97, and two vertical enclosures 99 extending from the horizontal bottom 97. The horizontal bottom 97 is generally aligned with the vertical center of each of the support members 37. The chamber 95, rests upon compacted sand 101 placed upon crushed stone 103.

The two vertical enclosures 99, include an outside enclosure 105 remote from the sand area 33, and an inside enclosure 107 adjacent to the support members 37. The inside enclosure 107 extends across the top of the support members 33 thereby covering the support members 33. A partial cap 109 is placed on the top 29 of the support members 33. The partial cap 109 has an inclined surface 111 to retain a cover 85 over the sand area 33, as was previously described for the cap 77. The partial cap 109 also, is secured to braces 113, which extend across the sand catcher 75 and is secured at its opposite end to the outside vertical enclosure 105. The braces 113 are located (FIG. 6) at both ends of each catcher section 91 and at the center of each catcher section 91.

A grate 114, preferably made of aluminum, is supported by braces 113. A mat 116 preferably of a rubber composition is placed over the grate 114. The grate 114 and the mat 116, have openings through them to permit sand to pass through them and then to drop into the chamber 95. A bolt 121 secures the partial cap 109 to the inside enclosure 107.

Beneath the sand area 33, either with a sand catcher 75 or without a sand catcher 75, there is crushed stone 127 with a thin layer of Geotextile 129 between the crushed stone and the sand in the sand area 33.

It to be understood that the drawings and description matter are in all cases to be interpreted as merely illustrative of the principles of the invention, rather than as limiting the same in anyway, since it's contemplated that various elements to achieve like results without departing from the spirit of the invention or the scope of the appending claims.

The invention claimed is:

1. A method for providing a jump pit in an athletic field, the method comprising:

providing an inclined surface beneath a surface of the athletic field and around at least a portion of a sand area of the jump pit, the inclined surface secured to a base disposed beneath the surface of the athletic field, and the inclined surface facing upwardly and away from the sand area; and supporting a cover on the inclined surface over the sand area of the jump pit so that an upper surface of the cover being disposed generally even with the surface of the athletic field with the cover abutting a synthetic track, and the cover being removed when the jump pit is in use to expose the sand area to define a landing area for athletes.

2. The method of claim 1 wherein the base comprises metal.

3. The method of claim 1 wherein the base comprises a plurality of prefabricated sections.

4. The method of claim 3 further comprising filling the plurality of prefabricated sections with cement.

5. The method of claim 1 wherein the providing the inclined surface comprises providing a lower portion of the inclined surface adjacent to an upper surface of the sand area of the jump pit.

6. The method of claim 1 wherein the providing comprises providing the inclined surface defining a flat inclined planar surface.

7. The method of claim 1 wherein the inclined surface comprises metal.

8. The method of claim 1 wherein the cover comprises an end portion comprising an angled surface supportable on the inclined surface.

9. The method of claim 1 wherein the cover comprises an end portion comprising a rigid angled surface supportable on the inclined surface.

10. The method of claim 1 wherein the cover comprises a plurality of side-by-side covers.

11. The method of claim 1 wherein the supporting the cover comprises supporting a generally rigid cover on the inclined surface over the sand area of the jump pit.

12. The method of claim 1 wherein the providing comprises providing the inclined surface beneath the surface of the athletic field and secured to the base comprising a base form disposed beneath the surface of the athletic field.

13. The method of claim 12 further comprising filling the base form with cement.

14. The method of claim 12 wherein the base form comprises support members having openings, and the filing of the base form with the cement comprises filing the cement between the openings in the support members.

15. The method of claim 1 wherein the providing comprises providing the inclined surface along at least two sides of the sand area of the jump pit.

16. The method of claim 1 wherein the providing comprises providing the inclined surface along two longitudinal sides of the sand area of the jump pit having a rectangular configuration.

17. The method of claim 1 wherein the providing comprises providing the inclined surface around at least three sides of the sand area of the jump pit having a rectangular configuration.

* * * * *